US011457758B2

(12) United States Patent
Thomas

(10) Patent No.: US 11,457,758 B2
(45) Date of Patent: Oct. 4, 2022

(54) UNIVERSAL ZIPPER AID

(71) Applicant: Oreetseng Minah Thomas, Decatur, GA (US)

(72) Inventor: Oreetseng Minah Thomas, Decatur, GA (US)

( * ) Notice: Subject to any disclaimer, the term of this patent is extended or adjusted under 35 U.S.C. 154(b) by 5 days.

(21) Appl. No.: 16/985,716

(22) Filed: Aug. 5, 2020

(65) Prior Publication Data

US 2021/0052100 A1 Feb. 25, 2021

Related U.S. Application Data

(60) Provisional application No. 62/882,756, filed on Aug. 5, 2019.

(51) Int. Cl.
*A47G 25/90* (2006.01)
*A44B 19/26* (2006.01)

(52) U.S. Cl.
CPC ..... *A47G 25/902* (2013.01); *A44B 19/262* (2013.01)

(58) Field of Classification Search
CPC ..... A44B 11/12; A44B 19/00; A44B 19/26; A44B 19/262; A47G 25/902; Y10T 24/2561; Y10T 24/2586; Y10T 24/2588; Y10T 24/2589; Y10T 24/3944; Y10T 24/3956; Y10T 24/44521; Y10T 24/4016
See application file for complete search history.

(56) References Cited

U.S. PATENT DOCUMENTS 1,297,456 A * 3/1919 Frey ..... A61M 39/284 251/10
2,835,952 A * 5/1958 Mininberg ..... A47G 25/902 294/3.6
2,887,751 A * 5/1959 Lamb ..... A47G 25/902 294/3.6
2,900,205 A * 8/1959 Cirone ..... A47G 25/902 294/3.6
2,974,991 A * 3/1961 Gerrick ..... A47G 25/902 294/3.6
3,355,779 A * 12/1967 Hurst ..... A47G 25/902 294/3.6
3,531,835 A * 10/1970 Paikin ..... A41F 1/00 24/516
3,836,189 A * 9/1974 Borrelli ..... A47G 25/902 294/3.6
4,022,506 A * 5/1977 Cloud, Sr. ..... A47G 25/902 294/3.6

(Continued)

*Primary Examiner* — Stephen A Vu
(74) *Attorney, Agent, or Firm* — Perilla Knox & Hildebrandt LLP; Jason M. Perilla

(57) ABSTRACT

Various examples of a device for aiding in closure of a zipper are disclosed. The device includes a body comprising a base portion and an elongated spring portion extending from the base portion, the elongated spring portion configured with a bend such that the elongated spring portion overlaps the base portion such that a distal portion of the elongated spring portion together with at least a portion of the base portion forms a gripping section to receive a zipper tab of the zipper; and a locking member comprising a lever arm and a tension member, the tension member positioned at an angle with respect to the lever arm, the locking member configured to pivot with respect to the body such that the tension member applies pressure to the elongated spring portion in a closed position to secure the zipper tab.

20 Claims, 4 Drawing Sheets

(56) References Cited

U.S. PATENT DOCUMENTS

| | | | | | |
|---|---|---|---|---|---|
| 4,787,266 | A * | 11/1988 | Romano | ..... | B62M 3/083 24/170 |
| 2004/0020017 | A1 * | 2/2004 | Nedbal | ..... | A44B 19/262 24/429 |

* cited by examiner

UNIVERSAL ZIPPER AID

CROSS-REFERENCE TO RELATED APPLICATION

This application claims the benefit of and priority to U.S. Provisional Application No. 62/822,756, titled "UNIVERSAL ZIPPER AID," filed on Aug. 5, 2019, the contents of which are hereby incorporated herein by reference in its entirely.

BACKGROUND

The difficulty that a person encounters when trying to zip or unzip a garment, particularly while wearing the garment, is a common nuisance many face. This is especially true when the zipper is at a difficult to reach location, such as on the back of the garment. In that case, the wearer may not be able to reach the zipper or fully zip or unzip the garment. Also, without assistance, zipping a zipper can be particularly problematic when the person is alone or traveling by themselves. Oftentimes, to avoid this problem, the wearer may avoid certain clothing options or wear an additional garment to conceal the partially zipped zipper.

Although there are dressing aids available that can attach to certain types of zippers, these aids can only be utilized with a zipper that has a hole punched in the zipper tab or pull. Thus, the currently available dressing aids are incapable of zipping up invisible or concealed zippers common to many garments that do not have a hole in the zipper tab. Furthermore, the existing aids may not adequately accommodate some individuals, such as stroke patients or other individuals with impaired motor function, who may no longer possess the hand dexterity or fine motor control to grip a zipper tab in their hands or be able to easily insert an object through such a small opening in the zipper tab or pull.

BRIEF DESCRIPTION OF THE DRAWINGS

For a more complete understanding of the embodiments and the advantages thereof, reference is now made to the following description, in conjunction with the accompanying figures briefly described as follows.

Figure 1:
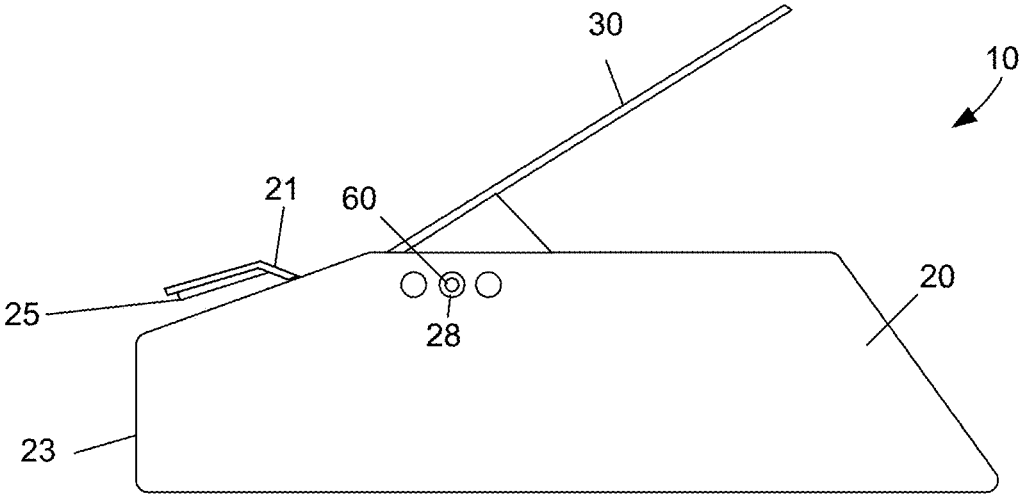
FIG. 1 illustrates an example of a side view of a zipper clasp according to various embodiments described herein.

The drawings illustrate only example embodiments and are therefore not to be considered limiting of the scope of the embodiments described herein, as other embodiments are within the scope of this disclosure. The elements and features shown in the drawings are not necessarily drawn to scale, emphasis instead being placed upon clearly illustrating the principles of the embodiments. Additionally, certain dimensions or positionings may be exaggerated to help visually convey certain principles. In the drawings, similar reference numerals between figures designate like or corresponding, but not necessarily the same, elements.

DETAILED DESCRIPTION

As noted above, people often face difficulty when trying to manipulate a garment's zipper when the zipper is located in a hard-to-reach location. The wearer either may not be able to reach the zipper tab or they may have difficulty fully zipping the garment open or closed. Furthermore, individuals who may not have the fine motor control to operate the zipper, such as stroke victims or other impaired individuals, may face difficulty when trying to wear certain garments because they may not have the necessary dexterity to operate a zipper. Consequently, dressing aids are useful because they extend the zipper tab and allow the person to zip the garment up or down, while wearing the garment, and makes such garments more convenient to wear.

However, dressing aids that are currently available achieve this purpose by relying on the opening punched into zipper tabs to attach the dressing aid to the zipper tab. For example, some dressing aids may have a hook or clip that connects the dressing aid to the zipper tab. Some wearers may simply tie or loop a length of material through the zipper tab hole and use the material to manipulate the zipper tab up or down.

However, currently available dressing aids can only be used on zipper tabs that have an opening in the tab. Therefore, they cannot be universally applied. The currently available dressing aids cannot be used on zippers that do not come with an opening in the tab, such as concealable zippers or invisible zippers. Furthermore, individuals that do not have the adequate dexterity, such as stroke victims or other individuals with impaired motor function, may not be able to use the currently available dressing aids because they may not possess the requisite fine motor function to attach the dressing aids into a small opening in the zipper tab.

In the context outlined above, the embodiments described herein are directed to a zipper clasp for attaching to different types of zipper tabs or pulls regardless of zipper size, shape, and whether or not there is an opening in the zipper tab. This universal-style zipper clasp provides an alternative to currently available dressing aids because it does not require the presence of an opening in the zipper tab. The zipper clasp described herein can secure around the zipper tab or pull of nearly any zipper. The zipper clasp is designed to apply a compressive force on the zipper tab, holding the zipper tab, using a locking member.

The zipper clasp may partially maintain its grip on the zipper tab through the friction from the material that lines the elongated spring clip and base part of the body that contacts the zipper tab. Furthermore, the zipper clasp is suitable to attach to a wide variety of different sized zipper tabs. In addition, the zipper clasp is advantageous for individuals with fine motor function impairment because they do not need to thread the dressing aid through the zipper tab opening. Instead, a person only needs to insert the zipper tab into the zipper clasp and press down on the locking member.

In one embodiment, the zipper clasp described herein may include a body, a locking member, and a pin to connect the locking member to the body. The zipper clasp may be made of materials including wood, metal, steel, metal allow, plastic, polymer, composite, other materials, and combinations thereof. The material of the body of the zipper clasp can be a non-rigid material that can be bent or molded, such that there is flexibility in the elongated spring clip. For example, the body of the zipper clasp can be made of an alloy steel sheet that is cut to shape then bent to form the sides and elongated spring clip. In some aspects, the thickness of the alloy steel sheet, or other sheet material, can have a varying thickness such that the body is more rigid and the portions of the sheet can be bent at predetermined locations to form the body of the zipper clasp.

Further, the zipper clasp may include a lining on at least one of the elongated spring clip and/or the base part of the body that comes into contact with the zipper tab when the zipper tab is inserted into the zipper clasp. The lining may be any of materials suitable for gripping a component including felt, silicon, rubber, plastic, other materials, or any combination thereof.

The body may be made from a single piece that may be bent to form the elongated spring clip, the base part, the first side wall, and the second side wall. In various embodiments, the first side wall and the second side wall extend from the base part and may be bent towards the elongated spring clip. In other embodiments, the first side wall and the second side wall are perpendicularly bent with respect to the base part. In various embodiments, the body may be made of a plurality of sections that are combined by fastening means to form the body. For example, the plurality of sections can be attached by mechanical fasteners, such as screws, rivets, and the like. For example, the plurality of sections can be attached by an adhesive, soldering, welding, and the like to form a unitary piece.

The locking member can be formed from a single piece that is bent to form the lever arm, the first support member and the second support member. The locking member can be also be formed such that the lever arm is shaped in one-piece, for example by molding. In various embodiments, the locking member can be made of a plurality of sections that are combined a fastening means to form the locking member.

In one embodiment, the zipper clasp may include a body, a locking member, a pin to attach the locking member to the body, and a corded member. The corded member can be made from materials including cotton, silk, wool, nylon, plastic, polymer, metal rope or chain, or other materials, and combinations thereof. The corded member may be attached to the zipper clasp at either the body or the locking member. Furthermore, in various embodiments, the zipper clasp may be made of smooth finishing material that may be less likely to snag, or catch, on fabrics. In various other embodiments, the zipper clasp may be lined with a smooth finishing material to prevent snagging, or catching, on fabrics.

In one embodiment, the zipper clasp may include a body and a locking member. The first support member and the second support member of the locking member may have a pin protruding from each of the lateral sides of the locking member. The pins on the locking member may be configured to fit into the holes on the first side wall and the second side wall of the body to pivotably attach the locking member to the body. In other embodiments, pins may be located on the inner surface of each of the first side wall and the second side wall. Consequently, the pins may be configured to insert into holes located on the first support member and the second support member of the locking member to pivotably attach the locking member to the body. In various other embodiments, the zipper clasp can use any of a plurality of hinges to connect the locking member to the body.

Turning to the drawings, FIG. 1 illustrates an example of a side view of a zipper clasp 10. At the outset, it is noted that the zipper clasp 10 is representative and not drawn to scale in FIG. 1. Additionally, the relative sizes of the components of the zipper clasp 10, as shown in FIG. 1, are not intended to be limiting, as the individual components of the zipper clasp 10 can vary in size and/or proportion as with respect to each other in various embodiments.

As shown in FIG. 1, the zipper clasp 10 includes a body 20, a locking member 30, and a pin 60. The locking member 30 is sized to fit within the body 20 with clearance. In this example, the holes 28 on the first side wall 23 and the second side wall 24 (not shown) of the body 20 are configured to receive the pin 60 of the zipper clasp 10. The zipper clasp 10 is configured such that the locking member 30 can pivot about the pin 60. In other examples, the locking member 30 can be attached to body 20 by other pivoting means. As shown in this example, the locking member 30 is in an open configuration such the elongated spring clip 25 is positioned to engage or grip a zipper tab (not shown). In a closed position, the locking member can be pivoted about pin 60, such that the tension member 34 engages and applies pressure to the elongated spring clip 25, thereby clamping an inserted zipper tab of a zipper.

The body 20 (FIG. 2) comprises an elongated spring clip 21, a base part 22, a first side wall 23, and a second side wall 24. One or more holes or openings 28 can be formed through the first side wall 23 and the second side wall 24, respectively. The elongated spring clip 21 and the base part 22 may include a lining 25 that can grip a zipper tab or pull that inserted into the zipper clasp 10. The locking member 30 is attached to the body 20 by a pin 60. The pin 60 is inserted through the hole 28 in the first side wall 23, through the locking member 30, and through a corresponding hole in the second side wall 24 of the body 20. The pin 60 can be secured by any suitable means. In various embodiments, the body 20 may have a pin on the inner surface of each of the first side wall 23 and the second side wall 24. The locking member 30 may pivotably connect to the body 20 by fitting the pins 60, though the holes 28 of the body 20, into the holes 38 disposed on the first support member 32 and the second support member 33 of the locking member 30. In other embodiments, the outer surface of each of the first support member 32 and the second support member 33 of the locking member 30 have pins. The locking member 30 may hingeably attach to the body 20 by fitting the pins into the holes disposed on the first side wall 23 and the second side wall 24 of the body 20. As mentioned above, the zipper clasp 10 may clamp onto the end of a zipper tab that may be inserted into the body 20 at the opening formed by the elongated spring clip 21 and the base part 22 when the locking member 30 is in the raised, or unlocking, position. Once the zipper tab is inserted into the opening, the locking member 30 may be pressed down, to the lock position, thereby causing the elongated spring clip 21 of the body 20 to clamp down against the base part 22 of the body 20 and thus securing the zipper tab. In various embodiments, the inner surface of the elongated spring clip 21 and the base part 22 that comes into contact with the zipper tab, when the locking member 30 is pressed down, may have a liner 25 made of a material that may partially aid in gripping the zipper tab.

The zipper clasp 10 may be made of a plurality of materials including steel, metal or metal alloy, wood, plastic, silicon, polymer, other materials, and any combination thereof. Furthermore, the corded member 41 may be made of a plurality of materials including silk, wool, nylon, cotton, plastic, metal or metal alloy, polymer, other materials, and combinations thereof. Also, the liner 25 (FIG. 4) may be made of a plurality of materials including silicon, rubber, plastic, felt, other materials, and combinations thereof.

Figure 2:
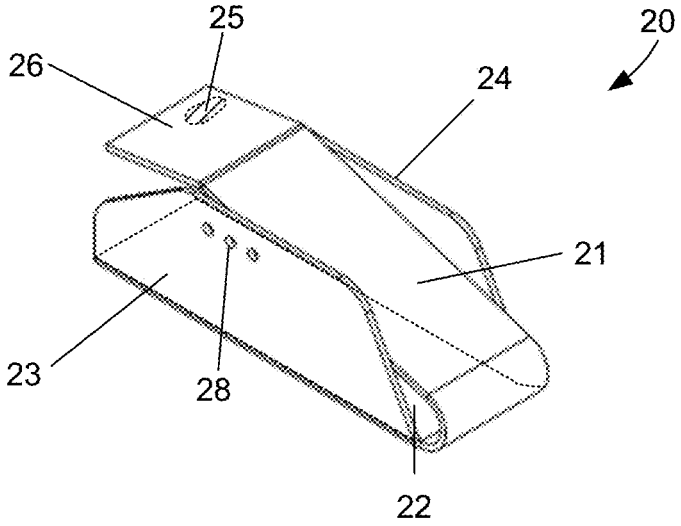
FIG. 2 illustrates an example of a perspective view of a base member of the zipper clasp shown in FIG. 1 according to various embodiments described herein.

Referring to FIG. 2, the body 20 may be formed from one continuous piece wherein the elongated spring clip 21, base part 22, first side wall 23, and the second side wall 24 may be formed by bending the piece to form the body 20. In other embodiments, there may be an opening in the body 20 to allow for attaching the corded member 41. In various embodiments, the elongated spring clip 21 may have an additional bent portion 26 at the proximal end to provide additional tension against a zipper tab when the locking member 30 (FIG. 1) is pressed down into the locked position. In other various embodiments, the body 20 may be formed by a plurality of parts that are connected by a plurality of means to form the body 20.

Figure 3:
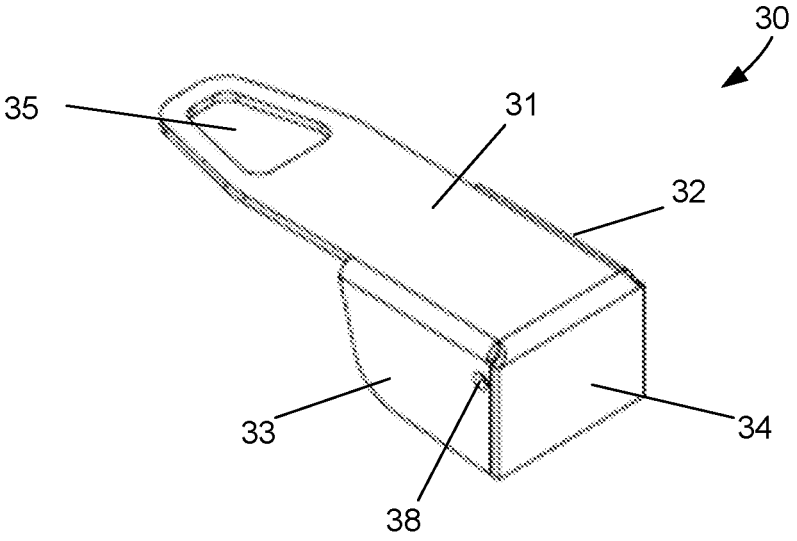
FIG. 3 illustrates an example of a perspective view of a locking member of the zipper clasp shown in FIG. 1 according to various embodiments described herein.

Referring to FIG. 3, the locking member 30 may be formed from one continuous piece that is bent to form the lever arm 31, the first support member 32, the second support member 33, and the tension member 34. A hole 38 may be disposed near the proximal end of the locking member 30 on each of the first support member 33 and the second support member 34 configured for a pin 60 so the locking member 30 may be attached to the body 20. In various embodiments, each of the first support member 32 and the second support member 33 may have pins on the outer surface of the support members 32, 33, wherein the pins are configured to insert into holes 28 on the first side wall 23 and the second side wall 24 of the body 20. The tension member 34 is formed at an angle with the lever arm 31, such that when the locking member 30 is assembled with the body 20, the locking member 30 pivots to engage in a locking position, where the tension member 34 engages with and applies pressure to the elongated spring clip 21 of the body 20. In various embodiments, the locking member 30 may be made of a plurality of members, wherein the members may be combined by any of a plurality of means to form the locking member 30. In some embodiments, the locking member 30 may have an opening 35 wherein a corded member 41 may be attached to the zipper clasp 10.

Figure 4:
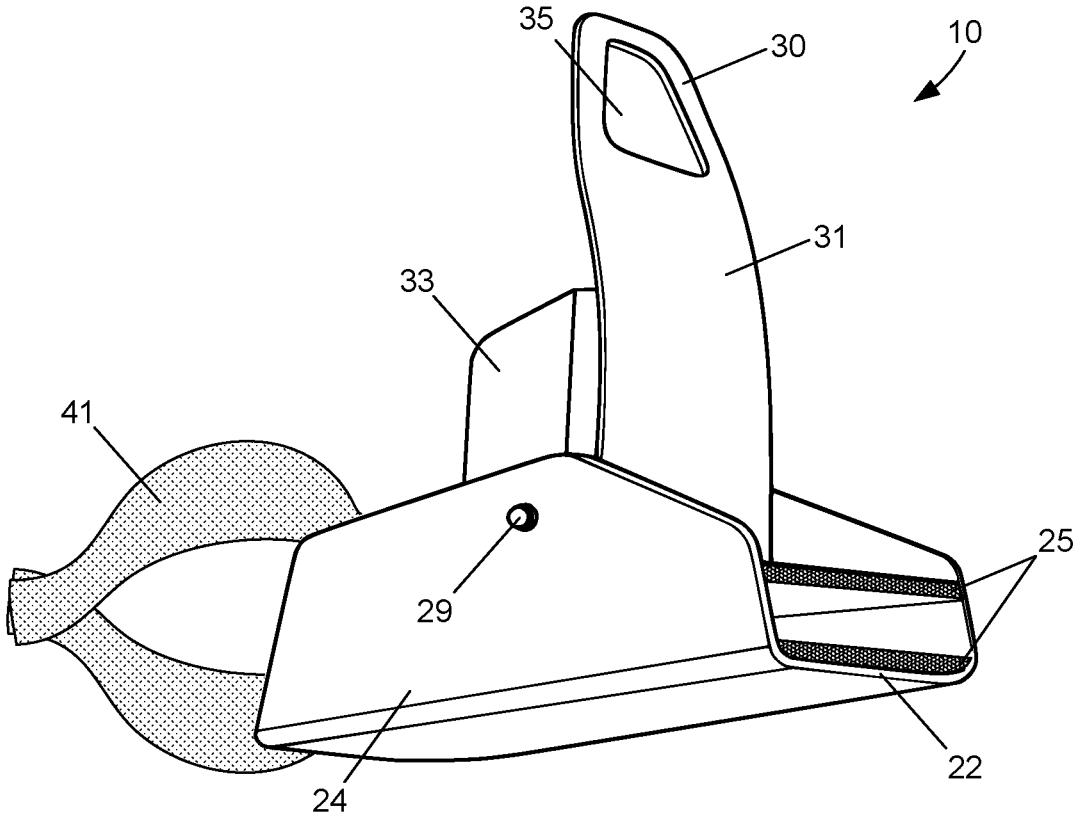
FIG. 4 is a perspective view of the zipper clasp according to various embodiments described herein.

Referring in FIG. 4, shown is one of the various embodiments of the zipper clasp 10 in the unlocked position. The corded member 41 may be a ribbon that may be connected to the body 20. In other embodiments, the corded member 41 may be a string, rope, chain, linked member, other configuration, or any of a plurality of materials. In various embodiments, the corded member 41 may be connected to the locking member 30 or any of a plurality of locations suitable for attached the corded member 41.

Figure 5:
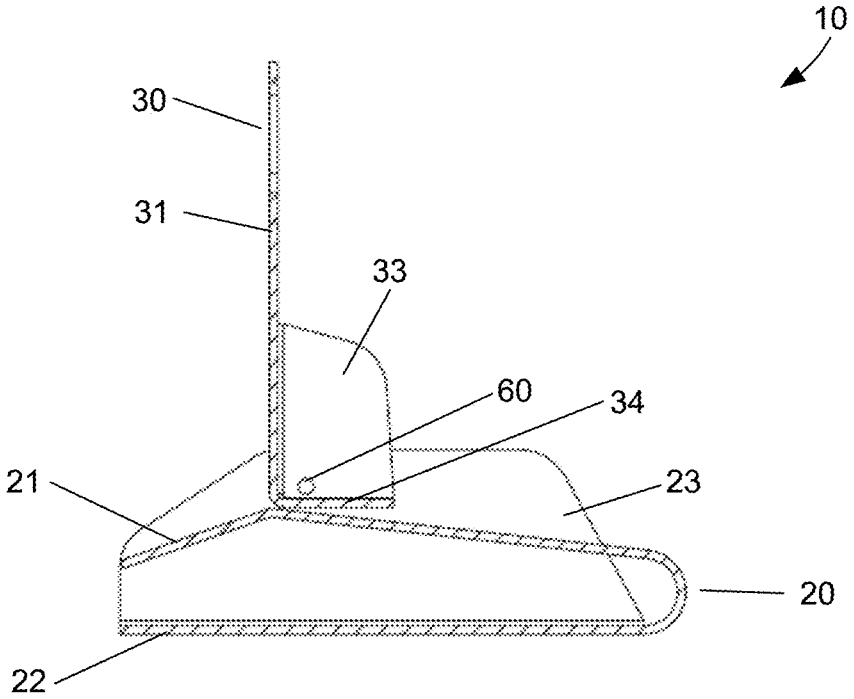
FIG. 5 illustrates an example of a cross-sectional view of the zipper clasp in the closed configuration according to various embodiments described herein.

Referring to FIG. 5, shown is a cross-sectional view of the zipper clasp 10 in the open position. In various embodiments of the present disclosure, the tension member 34 of the locking member 30 compresses the elongated spring clip 21 of the body 20 when the locking member 30 is pressed down into the lock position. Thus, the elongated spring clip 21 is pressed against the base part 22 of the body 20 and clamps down on a zipper tab that is inserted between the elongated spring clip 21 and the base part 22 at the proximal end. In various embodiments of the present disclosure, the locking member 30 pivotably rotates around the pin 60 to clamp the elongated spring clip 21 onto the base part 22.

Figure 6:
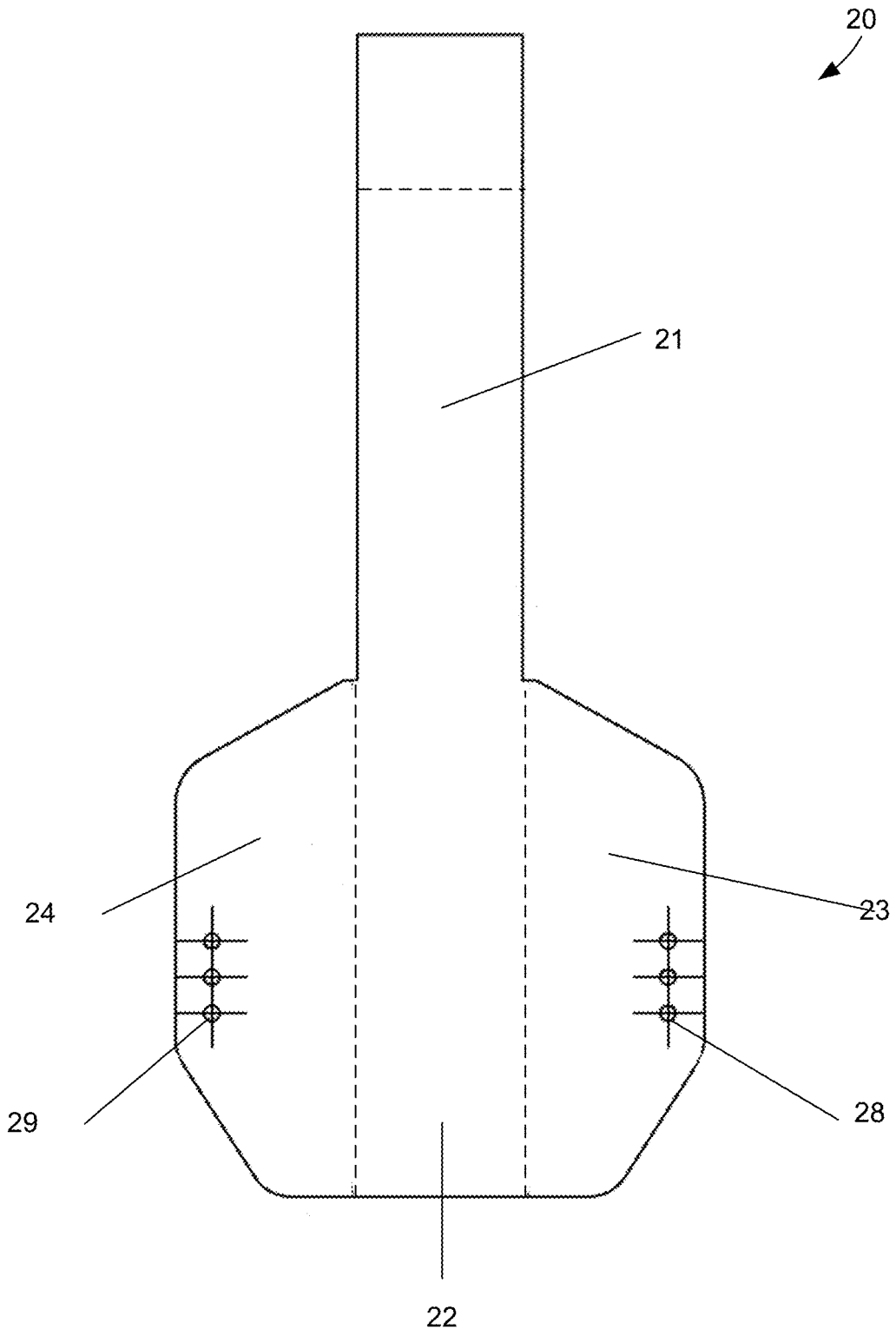
FIG. 6 illustrates an example a body of the zipper clasp before it is bent according to various embodiments described herein.

Referring to FIG. 6, shown is a body 20 as a single piece before it is bent to form the elongated spring clip 21, the base part 22, the first side wall 23, the second side wall 24, and the one or more hole 28 on each of the first side wall 23 and the second side wall 24. In some embodiments, the elongated spring clip 21 may also be slightly bent near the distal end to increase the tension the elongated spring clip 21 applies to the base part 22 when the locking member 30 is pressed into the lock position.

For example, as shown in FIG. 6, the body 20 can formed in a single sheet, where the elongated spring clip portion 21 extends from a polygonal portion comprising the base part 22 and the sidewalls 23 and 24. As indicated by a first set of dashed lines, the vertical dashed lines in FIG. 6, the base part 22 and elongated spring clip portion 21, together, are substantial rectangular in shape. The side walls 23 and 24 can be formed by bending the side wall up to and including 90° at positions indicated by a first set of dashed lines. The elongated spring clip portion 21 positioned by bending the body 20 where the elongated spring clip portion 21 and base part 22 meet at an angle of about 160° to about 165°, with a radius, such that the elongated spring clip portion 21 extends over the base part 22. A gripping portion can be formed on the elongated spring clip portion 21 by further bending the elongated spring clip portion 21 at an angle up to about 26° at a location near the distal portion, such as the horizontal dashed lines indicated on FIG. 6. Similarly, the locking member 30 can be can formed in a single sheet such that the first support member 32, the second support member 33, and the tension member 34 can be formed by bending the sheet at selected location at an angle up to and including 90°. As can be understood, the size and thickness of the sheet can be scaled to correspond to the size of corresponding zipper while maintain the relative proportions of the device.

Although embodiments have been described herein in detail, the descriptions are by way of example. The features of the embodiments described herein are representative and, in alternative embodiments, certain features and elements can be added or omitted. Additionally, modifications to aspects of the embodiments described herein can be made by those skilled in the art without departing from the spirit and scope of the present invention defined in the following claims, the scope of which are to be accorded the broadest interpretation so as to encompass modifications and equivalent structures.

At least the following is claimed:

1. A device for aiding in closure of a zipper, the device comprising:

a body comprising a base portion and an elongated spring portion extending from the base portion, the elongated spring portion configured with a bend such that the elongated spring portion overlaps the base portion such that a distal portion of the elongated spring portion together with at least a portion of the base portion forms a gripping section to receive a zipper tab of the zipper; and a locking member comprising a lever arm, an opening formed in one end of the locking member, a first support member, a second support member, and a tension member extending at an angle with respect to another end of the lever arm, the locking member configured to pivot with respect to the body such that, in a closed position of the locking member with respect to the body, the tension member applies pressure to the elongated spring portion with the opening positioned toward the bend of the body.

2. The device of claim 1, wherein the body further comprises a pair of side walls, wherein the elongated spring portion has a width configured to fit with a clearance between the pair of side walls of the body.

3. The device of claim 2, wherein each side wall of the pair of side walls of the body comprises one or more holes configured to receive a pin to pivotably attach the locking member with the body.

4. The device of claim 1, wherein the first support member and the second support member extend substantially perpendicular to the lever arm.

5. The device of claim 1, further comprising a bend at the distal portion of the elongated spring portion.

6. The device of claim 1, further comprising a gripping material applied to at least a portion of the distal portion of the elongated spring portion and at least a portion of the base portion that together form the gripping section.

7. The device of claim 1, further comprising a cord attached to the body or the locking member.

8. The device of claim 1, wherein the body is made from a steel, a metal alloy, a polymer, a composite, or combination thereof.

9. The device of claim 1, wherein the body is formed in a sheet and shaped by bending at least the elongated spring portion into position.

10. The device of claim 1, wherein the locking member is formed in a sheet and shaped by bending at least the tension member into position.

11. A method for aiding in closure of a zipper using the device of claim 1, comprising:

inserting the zipper tab of the zipper into the gripping section of the device;

pivoting the locking member to the closed position to secure the zipper tab; and pulling the device in a direction to close the zipper.

12. A zipper clasp comprising:

a clasp body, wherein the clasp body comprises:

a base part and an elongated spring clip, wherein the elongated spring clip extends from one side edge of the base part with a bend; and a first side wall and a second side wall, wherein the first side wall and the second side wall laterally extend from the base part and each comprises a hole; and a locking member, wherein the locking member is disposed between the first side wall and the second side wall of the clasp body and comprises:

a lever arm;

an opening formed in one end of the locking member;

a tension member extending at an angle with respect to another end of the lever arm; and a first support member and a second support member, wherein each of the first support member and the second support member further comprises a hole; and a pin, wherein:

the pin is configured to hingeably connect the locking member to the clasp body such that, in a closed position of the locking member with respect to the clasp body, the tension member applies pressure to the elongated spring clip with the opening positioned toward the bend of the clasp body.

13. The zipper clasp of claim 12, wherein the zipper clasp substantially comprises any of a plurality of materials including metal or plastic.

14. The zipper clasp of claim 12, wherein an inner portion of each of the elongated spring clip and the base part of the clasp body further comprises a lining suitable to grip a zipper tab.

15. The zipper clasp of claim 12, wherein the zipper clasp further comprises a cord member.

16. The zipper clasp of claim 15, wherein the zipper clasp and the cord member further comprises smooth finishing materials.

17. The zipper clasp of claim 12, wherein the lever arm is configured to be pressed on to the elongated spring clip.

18. The zipper clasp of claim 12, wherein the zipper clasp is configured to accommodate a plurality of zipper shapes and sizes.

19. The zipper clasp of claim 12, wherein the first side wall and the second side wall are perpendicular to the elongated spring clip and the base part.

20. The zipper clasp of claim 12, wherein the first support member and the second support member are disposed at a proximal corner of the locking member where the locking member is bent to form the tension member.

* * * * *